US010342269B1

(12) United States Patent
Rutkoski et al.

(10) Patent No.: US 10,342,269 B1
(45) Date of Patent: Jul. 9, 2019

(54) SUPPORTIVE TRANSPARENT BRA

(71) Applicants: Celia Rutkoski, Paris (FR); Audrey Wilson, Paris (FR)

(72) Inventors: Celia Rutkoski, Paris (FR); Audrey Wilson, Paris (FR)

( * ) Notice: Subject to any disclaimer, the term of this patent is extended or adjusted under 35 U.S.C. 154(b) by 0 days.

(21) Appl. No.: 16/105,275

(22) Filed: Aug. 20, 2018

(51) Int. Cl.
*A41F 15/00* (2006.01)
*A41C 3/00* (2006.01)
*A41F 1/00* (2006.01)
*A41C 3/12* (2006.01)

(52) U.S. Cl.
CPC ..... *A41C 3/0028* (2013.01); *A41C 3/0057* (2013.01); *A41C 3/122* (2013.01); *A41F 1/006* (2013.01); *A41F 15/002* (2013.01)

(58) Field of Classification Search
CPC ..... A41C 3/0028; A41C 3/0057; A41C 3/12; A41C 3/122; A41C 15/002; A41F 1/006
USPC ..... 450/88, 89, 85; 2/67
See application file for complete search history.

(56) References Cited

U.S. PATENT DOCUMENTS 2,363,017 A * 11/1944 Plehn ..... A41F 1/006 450/77
2,372,855 A * 4/1945 Reid ..... A41C 3/00 450/59
2,445,449 A * 7/1948 Moon ..... A41C 3/00 450/59
2,590,915 A * 4/1952 Allison ..... A41C 3/00 450/71
3,157,182 A * 11/1964 Fridolph ..... A41C 3/00 450/27
6,155,906 A * 12/2000 May ..... A41F 15/002 450/1
6,179,687 B1 * 1/2001 Lee ..... A41F 1/006 2/67
6,283,821 B1 * 9/2001 Wang ..... A41C 3/0042 2/311
6,656,013 B1 * 12/2003 Wang ..... A41F 15/002 2/244
D503,026 S * 3/2005 Sirimarco ..... 450/88
7,938,711 B1 * 5/2011 Johnston ..... A41F 1/006 450/1
D709,670 S * 7/2014 Vericella ..... D2/708
D765,946 S * 9/2016 DeCotiis ..... D2/706
2006/0189254 A1 * 8/2006 Hood ..... A41C 3/0007 450/86
2013/0237124 A1 * 9/2013 Hall ..... A41C 3/00 450/38
2013/0303050 A1 * 11/2013 Jackson ..... A41C 3/00 450/38
2015/0258572 A1 * 9/2015 Lee ..... B01J 20/06 427/244

* cited by examiner

*Primary Examiner* — Gloria M Hale
(74) *Attorney, Agent, or Firm* — Baker & McKenzie, LLP

(57) ABSTRACT

An article of clothing is described. The article of clothing includes a main body having supportive cup members. The article of clothing further includes an transparent top back strap having a fastener on each end of the top back strap, and an transparent bottom back strap having a bottom back strap fastener at one end. The article of clothing further includes transparent shoulder straps, where the shoulder straps are attached to the main body portion at one end, and attached to the top back strap at an other end.

19 Claims, 10 Drawing Sheets

SUPPORTIVE TRANSPARENT BRA

FIELD OF THE INVENTION

The present invention generally relates to brassieres. More particularly, the invention relates to bras for use by women who need a supportive bra that does not show under her garment (e.g. leotard or costume) in active applications such as dancing, figure skating, and other forms of sport where aesthetics matter.

BACKGROUND

Conventional bras generally include a bust support section coupled to one or more straps in various configurations. For everyday use, such bras provide adequate support throughout normal movement. However, for wearer who engages in high physical activity, such as dancing, or other forms of sport, conventional bras may not provide adequate support. For women with larger busts, unsupported movement can be uncomfortable, but may also lead to physical ailments such as back pain.

Conventional bras and sports bras can provide the required support for women with a larger bust. However, it is not always esthetically acceptable to wear a sports bra since the bra back and shoulder straps show under a dance leotard. As illustrated in FIG. 1, a conventional sports bra 100 is readily visible when worn under a conventional low-cut back leotard 200 worn by dancers.

Ballet dancers are traditionally small in stature and bust size, and usually have little or no need for support under their leotard. In today's world, more and more women of all body types are taking dance classes, joining dance troupes, drill teams, etc. Larger busted women need invisible support under their leotards, costumes and garments.

Dance bras on the market provide more "coverage" than support and exist only for small busted women with the largest size for "C-cups". There is a need for a bra that supports women with a larger bust size that meets both active and aesthetic requirements for dancers, performers and girls/women who would like an invisible supportive bra under their garments.

BRIEF SUMMARY

In one embodiment, an article of clothing is described. The article of clothing includes a main body portion having two cup members. The article of clothing further includes a top back strap having a fastener on each end, and a bottom back strap having a bottom back strap fastener at one end. The article of clothing further includes shoulder straps, where the shoulder straps are attached to the main body portion at one end, and to the top back strap at the other end.

In another embodiment, an undergarment is described. The undergarment includes a main body having a first fastener, a second fastener, and a third fastener. The undergarment further includes a first bra strap that includes a first end having a number of first loops and a second end having a number of second loops, and a second bra strap that includes a first end having a number of third loops. A user may insert the first fastener into one of the first loops, the second fastener into one of the second loops, and the third fastener into one of the third loops.

In another embodiment, an article of clothing is described. The article of clothing includes a main body having two cup members and five hook fasteners. The article of clothing further includes a first strap attached to the main body via the first and second hook fasteners, a second strap directly attached to the body at one end and attached to the main body via the third hook fastener at another end, and a third and fourth straps attached to the main body via the fourth and fifth hook fasteners at one end and attached to the first strap at another end.

BRIEF DESCRIPTION OF DRAWINGS

Reference is now made to the following descriptions taken in conjunction with the accompanying drawings.

DETAILED DESCRIPTION

Various embodiments of a bra are described according to the present disclosure. It is to be understood, however, that the following explanation is merely exemplary in describing the devices and methods of the present disclosure. Accordingly, several modifications, changes, and substitutions are contemplated.

Figure 1:
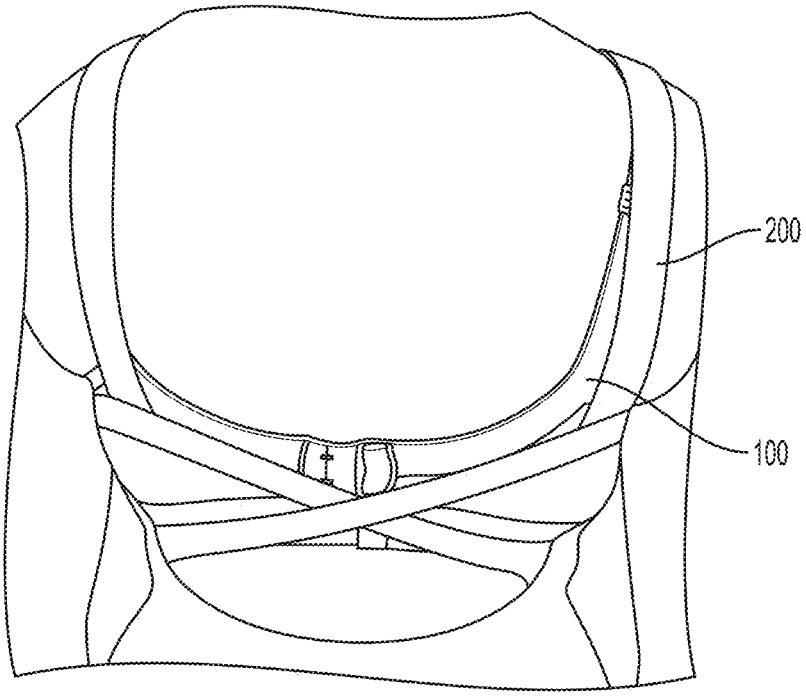
FIG. 1 illustrates a conventional bra as worn under a low-cut back leotard.
Figure 2:
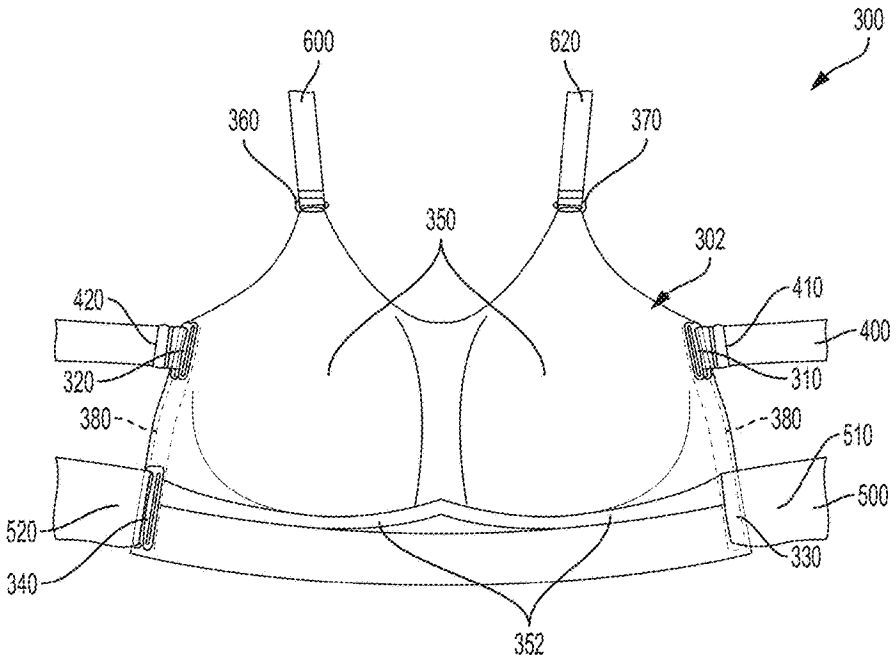
FIG. 2 is a front view of a bra according to an embodiment of the present disclosure.

FIG. 2 shows a bra 300 in accordance with one embodiment of the present invention. The bra 300 preferably includes a main body 302 having cup members 350. The cup members 350 may be any size from AA cup and up. In an embodiment, the cup members 350 are sized C and up to provide support for wearer with larger busts during active application. In accordance with a preferred embodiment of the present invention, each cup member 350 may further include underwire members 352. Each cup member 350 may include individual underwire member 352, or, alternatively, a single unitary underwire member 352 may extend through both cup members 350. In an embodiment, the main body 302 includes boning strips 380 on the sides. The boning strips 380 may be made from plastic or any other appropriate material. The boning strips 380 may be disposed and secured inside the bra main body 302 so that they are hidden by bra fabric. The boning strips 380 provide structural support to the sides of the bra main body 302 and allows fasteners and bra straps to be securely attached to the bra main body 302.

Bra 300 further includes a top back strap 400, and a bottom back strap 500, both of which are attachable to the main body 302. The top back strap 400 includes a left end 410 and right end 420. The left end 410 of the top back strap 400 is attachable to the main body 302 via a top back strap left fastener 310, and the right end 420 of the top back strap 400 is attachable to the main body 302 via a top back strap right fastener 320. In an embodiment, the fasteners 310 and 320 are secured onto the bra main body 302 by being sewn or otherwise attached to the boning strips 380 within the bra main body 302. The bottom back strap 500 includes a left end 510 and a right end 520. In an embodiment of the present invention, the left end 510 of the bottom back strap 500 is attached to a bottom section 330 of the main body 302, and the right end 520 of the bottom back strap 500 is attachable to the main body 302 via a bottom back strap fastener 340. In an embodiment, the bottom back strap 500 and the fastener 340 are secured onto the bra main body 302 by being sewn or otherwise attached to the boning strips 380 within the bra main body 302.

Bra 300 further includes shoulder straps 600 and 620, each disposed on top of a respective cup member 350. The shoulder straps 600 and 620 are attachable, at first ends of the shoulder straps, to shoulder strap fasteners 360 and 370 respectively. The shoulder straps 600 and 620 are attachable, at second ends of the shoulder straps, to the top back strap 400. Details of how the shoulder straps 600 and 620 are attachable at the first ends to the shoulder strap fasteners 360 and 370 will be discussed below in reference to FIG. 8, and the details of how the shoulder straps 600 and 620 are attachable at the second ends to the top back strap 400 will be discussed below in reference to FIGS. 9 and 10A-10C.

Bra main body 302 may be made from material appropriate for support, comfort and transparency. In an embodiment of the invention, the bra main body 302 is made from polyester, nylon, elastane, and/or polyurethane. The bra main body 302 may be of any color. In an embodiment of the invention, the main body 302 may be any color that blends in with the skin tone of the wearer. The main body 302 may also be transparent, and be made from transparent material selected from the group consisting of polyester, nylon, elastane, and polyurethane.

Figure 3:
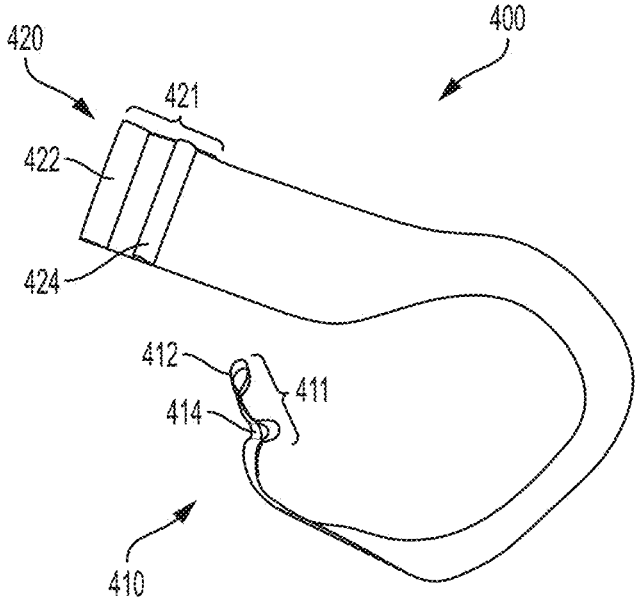
FIG. 3 is a perspective view of an embodiment of a top bra strap.

FIG. 3 discloses an enlarged view of the top back strap 400. As discussed above with respect to FIG. 2, the top back strap 400 includes a left end 410 and right end 420. In an embodiment of the present invention, each end of the top back strap 400 includes a fastener. For example, the left end 410 of the top back strap 400 includes a left fastener 411, and the right end 420 of the top back strap 400 includes a right fastener 421. In an embodiment of the present invention, the fasteners 411 and 421 each include a number of loops capable of receiving a hook fastening mechanism. As shown in FIG. 3, the left fastener 411 includes a first left loop 412 disposed at a distal end of the top back strap 400, and the right fastener 421 includes a first right loop 422 disposed at a distal end of the top back strap 400 opposite from the first left loop 412. It should be appreciated that more than one such receiving loops can be included in the left and right fasteners 411 and 421. In an embodiment of the present invention, the left fastener 411 may also include a second left loop 414 disposed near the first left loop 412, and the right fastener 421 may also include a second right loop 424 disposed near the first right loop 422.

Figure 4:
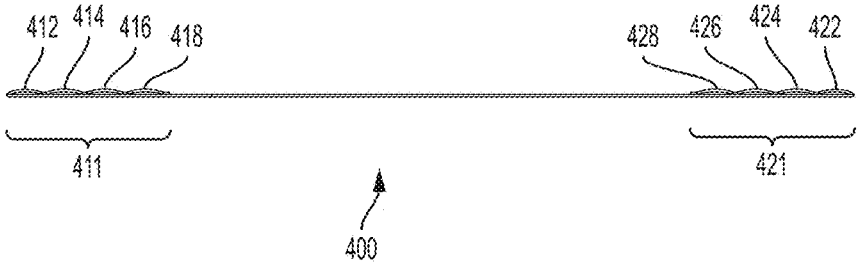
FIG. 4 is a side view of another embodiment of the top bra strap.

FIG. 4 discloses an embodiment of the top back strap 400, where each fastener 411 and 421 of the top back strap 400 includes more than two loops. Specifically, left fastener 411 includes a first left loop 412, second left loop 414, third left loop 416, and fourth loop 418. Right fastener 421 includes a first right loop 422, a second right loop 424, and third right loop 426, and a fourth right loop 428. The top back strap 400 may approximately 20-40 mm wide, and 450-500 mm long. Each loop may be 15-25 mm in width as measured along the length of the top back strap, and a small gap of approximately 2-3 mm may be disposed between each loop. It should be appreciated that the dimensions of the top back strap above can be varied as needed.

Figure 5:
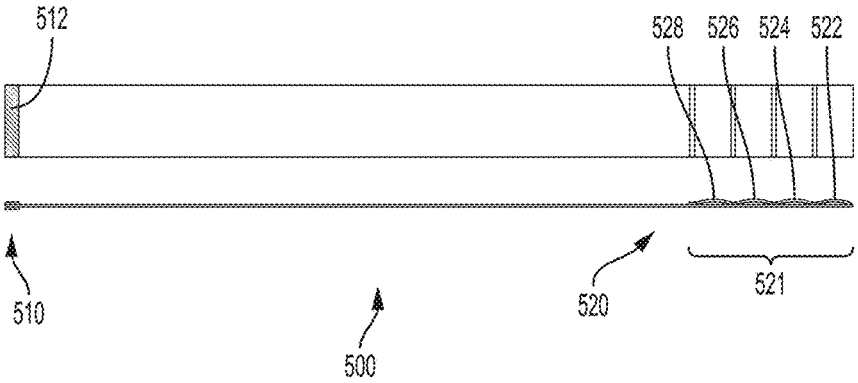
FIG. 5 is a side view of an embodiment of a bottom bra strap.

FIG. 5 illustrates an embodiment of the present invention of the bottom back strap 500. As discussed in FIG. 2 above, the bottom back strap includes a left end 510 and right end 520. A bottom back strap fastener 521 of the bottom back strap 500 may be disposed on either the left end 510 or right end 520. In an embodiment of the present invention, the bottom back strap fastener 521 is disposed on the right end 520, and includes a bottom strap loop 522 at a distal end of the bottom back strap 500. In an embodiment of the present invention, the bottom back strap fastener 521 may include any number of loops. As illustrated in FIG. 5, the bottom back strap fastener 521 may include the first bottom strap loop 522, second bottom strap loop 524, third bottom strap loop 526, and fourth bottom strap loop 528. Similar to the loops disposed on the top back strap 400, the loops of the bottom back strap fastener 521 may be approximately 20 mm wide, and a small gap of approximately 2-3 mm is disposed between each loop.

As discussed above, bottom back strap 500 includes a bottom back strap fastener 521 disposed on one end of the bottom back strap 500. At the end opposite to the where the bottom back strap fastener 521 is located, the bottom back strap 500 may be attached to the bra body 302 without using a loop or other detachable fastener mechanism. Specifically, the bottom back strap 500 may be directly attached to the bra body 302 at the left end 510 by means of being sewn onto the bra body 302. In an embodiment, the left end 510 of the bottom back strap 500 includes a reinforced piece 512 that is sewn to boning strip 380 so as to be securely attached to the bra main body 302. By using an attachment method different from the loop fasteners as previous discussed, the bottom back strap 500 is attached to the bra body 302 so that the bottom back strap 500 is difficult to detach from the bra body 302. This is so that the bottom back strap 500 is more securely fastened to the bra at one end 510. The other end of the bottom back strap 500 includes loops 520, which allows the wearer to select the loop to be used with a fastener, thereby adjusting the strap length of the bottom back strap 500.

The bottom back strap 500 may be different in dimension when compared to the top back strap 400. In an embodiment of the present invention, the bottom back strap 500 may be 30-50 mm wide and 400-600 mm long. In an embodiment, the bottom back strap is wider than the top back strap so as to provide more bottom side support for wearer with larger bust. Both the top and bottom back straps 400 and 500 may be made from any material suitable to secure the bra body 302 onto to wearer. In an embodiment, the straps 400 and 500 are made from plastic. In other embodiments, the straps 400 and 500 are made from lycra and nylon. In an embodiment, the top back strap 400 and the bottom back strap 500 are easily manufactured, as an end of a length of bra strap material can be simply folded and attached to itself at intermittent intervals (forming the gaps discussed above) so that the bra strap material forms the loops shown in FIGS. 4 and 5. The top back strap 400 and bottom back strap 500 may be transparent, flexible, and stretchable, so as to better adapt and support the wearer during physical activity.

Figure 6:
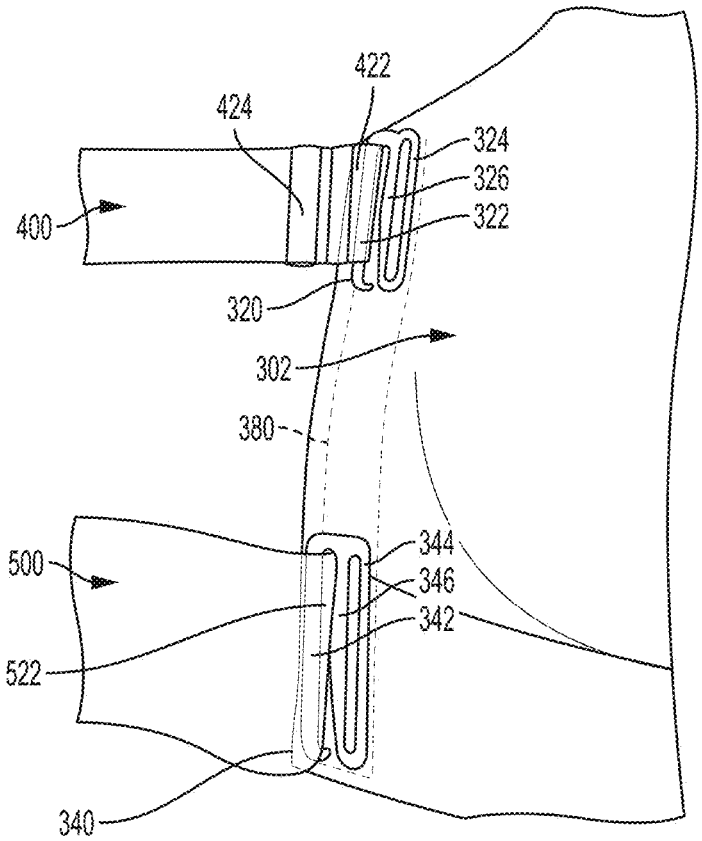
FIG. 6 is an expanded view of the right side of the bra as shown in FIG. 2.

FIG. 6 illustrates a right side of the bra 300 in detail, where the top back strap 400 and bottom back strap 500 are fastened to the bra main body 302 via the top back strap right fastener 320 and bottom back strap fastener 340 respectively. In an embodiment, the fasteners 320 and 340 are attached to the bra main body 302 by being sewn onto the boning strip 380 that is within the bra main body 302. In an embodiment, the fastener 320 includes a hook end 322 and a closed end 324, where the two ends are separated by a divider 326. In order to attach the top bra strap 400 to the main bra body 302, a loop, shown in FIG. 6 as first right loop 422, is inserted to accept the hook end 322 of the fastener 320, where the hook and tension on the bra strap will keep the bra strap relatively in place. If the user wants to adjust the length of bra strap, the user may select a different loop (e.g. second right loop 424) to insert to accept the hook end 322. Similarly, the bottom strap 500 may be attached to the bra main body 302 using a similar method, by inserting the first bottom strap loop 522 to accept a hook end 342 of the bottom back strap fastener 340. The bottom back strap fastener 340 may also include the closed end 344 and divider 346 as shown.

Figure 7:
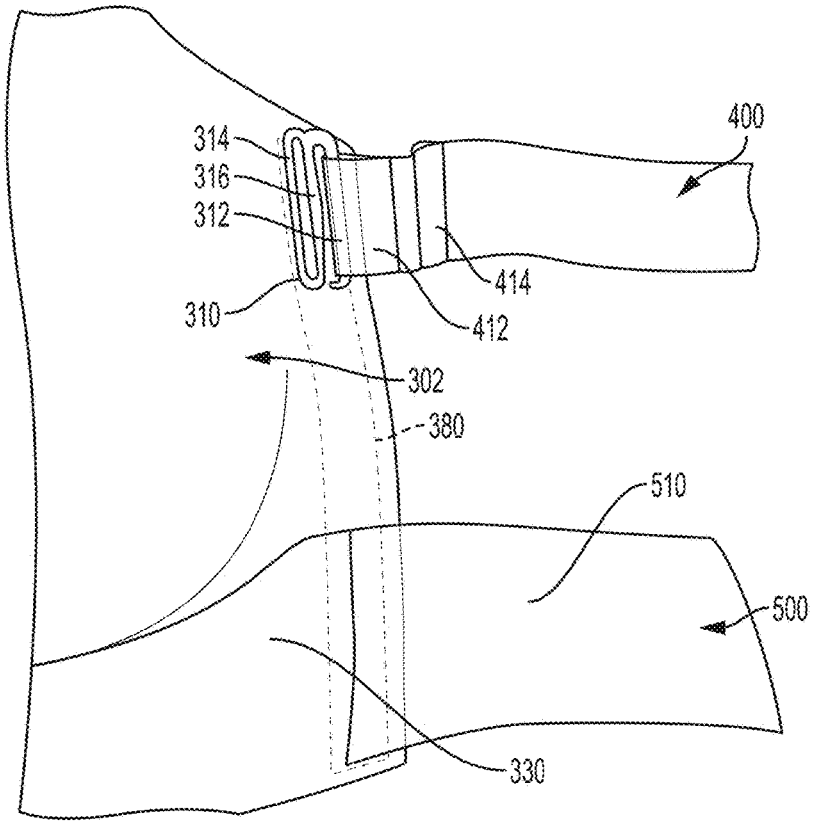
FIG. 7 is an expanded view of the left side of the bra as shown in FIG. 2.

FIG. 7 illustrates a left side of the bra 300 in detail, where the top back strap 400 and bottom back strap 500 are attached to the bra main body 302. In an embodiment, the top back strap 400 is attached to a top back strap left fastener 310 that is attached to the bra main body 302. The fastener 310, similar to the other fasteners 320 and 340, include a hook end 312, closed end 314, and divider 316. To perform the attachment, a loop (e.g. first left loop 412) is inserted to accept the hook end 312 where the hook and tension on the bra strap will keep the bra strap relatively in place. If the user wants to adjust the length of bra strap, the user may select to insert a different loop (e.g. second left loop 414) to accept the hook end 312. In an embodiment, the left end of the bottom strap 510 is attached to the left bottom end 330 of the bra main body 302 in a non-detachable manner. For example, the left end of the bottom strap 510 may be sewn onto the boning strip 380 within the bra main body 302 at the left bottom end 330. In an embodiment, the left end of the bottom bra strap 510 may include loop type fasteners similar to fastener 521, and the left bottom end 330 of the bra main body 302 would include a hook type fastener that may be inserted into the loop fastener of the left end of bottom bra strap 510. In this embodiment, the bottom back strap 500 would be similar to the top back strap 400 in that both straps would include a number of loop fasteners disposed on distal ends of the straps.

Figure 8:
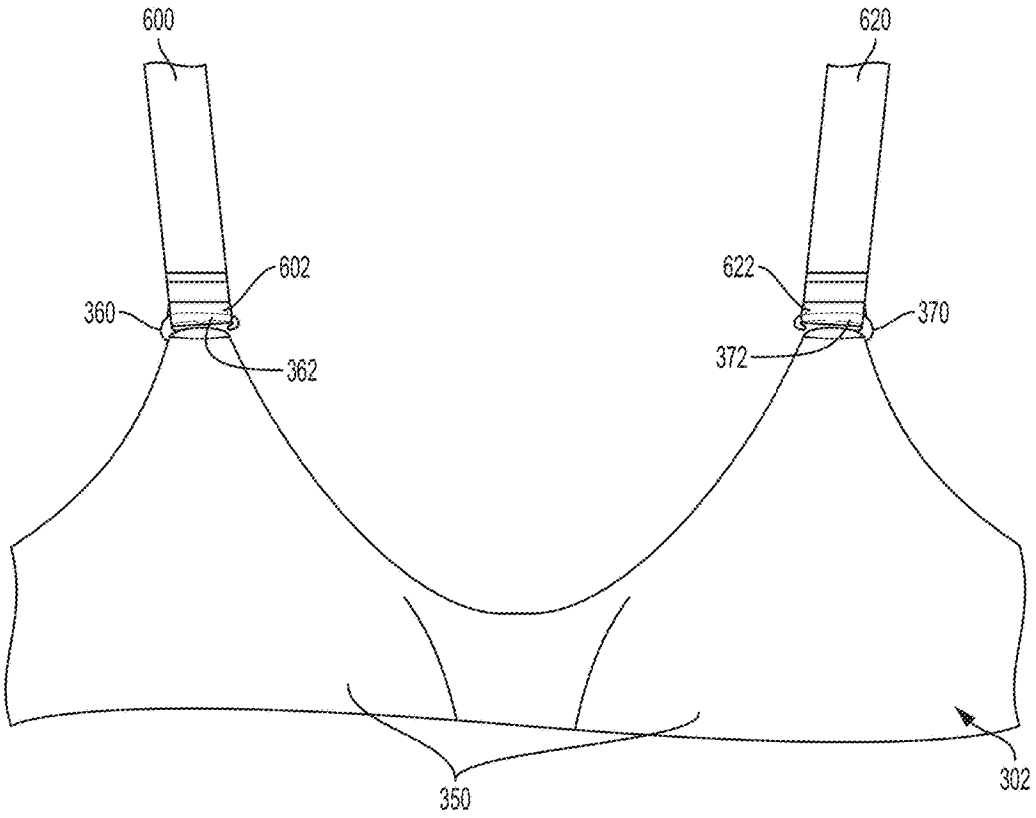
FIG. 8 is an expanded view of the top side of the bra as shown in FIG. 2.

FIG. 8 illustrates how shoulder straps 600 and 620 may be coupled to the bra main body 302. Shoulder straps 600 and 620 each include a shoulder strap loop 602 and 622 at the ends of the respective shoulder strap. Bra main body 302 includes two cup members 350, where shoulder strap fasteners (360, 370) are attached above respective cup members 350. To fasten the shoulder straps onto the bra main body 302, shoulder strap loop 602 is inserted to accept a shoulder strap hook 362 of the shoulder strap fastener 360, and a shoulder strap loop 622 is inserted to accept a shoulder strap hook 372 of the shoulder strap fastener 370. In embodiments discussed in view of FIG. 10A-C, each shoulder strap 600 may include additional loops or other fastener types to connect to the bra main body 302 so that the shoulder straps 600 may be adjustable in length. In an embodiment, the hook type fasteners 310, 320, 340, 360 and 370 may be made from any type of metal, plastic, or any other material that such fasteners may be made from. The fasteners 360 and 370 may be structurally the same as fasteners 310, 320 and 340, having hook end, closed end, and divider portion. The fasteners 310, 320, 340, 360 and 370 may be appropriately dimensioned so as to receive the full width and loop of the respective straps into the hook section.

Figure 9:
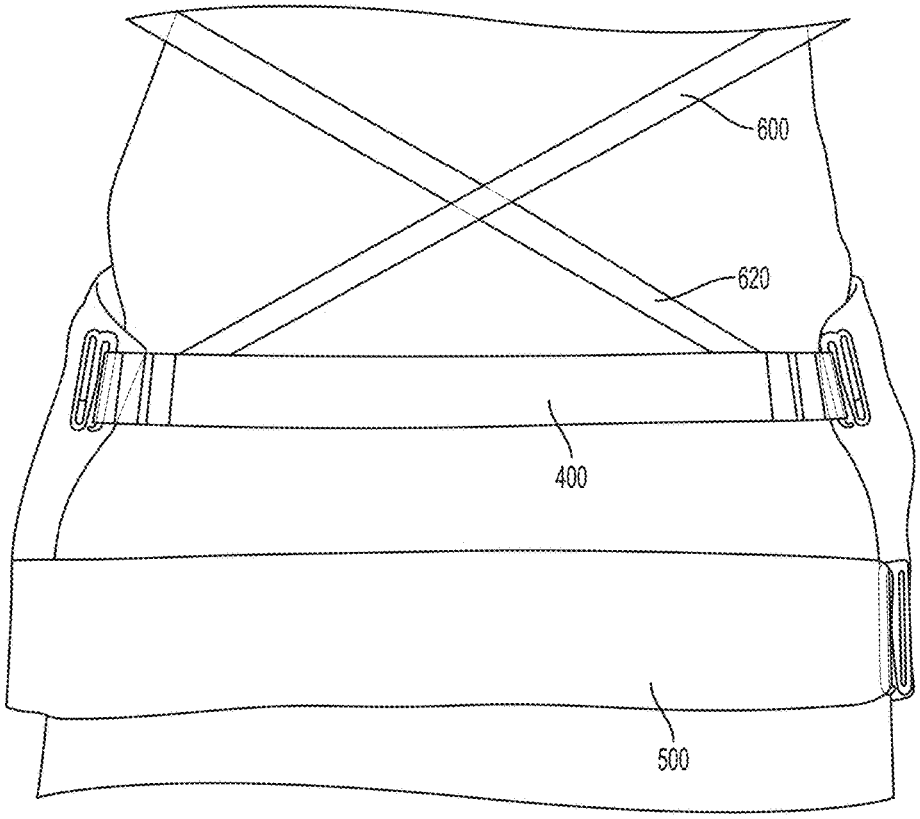
FIG. 9 is a back view of the bra according to an embodiment of the present disclosure.

FIG. 9 illustrates an embodiment of the configuration of the bra straps usable by the wearer. In this "X" strap configuration, the shoulder straps 600 and 620 are coupled on the sides of the top back strap 400 so that the shoulder straps cross each other to form an "X" around the shoulder area of the wearer. In a particular embodiment, each shoulder strap is permanently fused to the top bra strap 400. The other ends of the shoulder straps are coupled to the bra main body 302 as discussed above in view of FIG. 8.

Figure 10A:
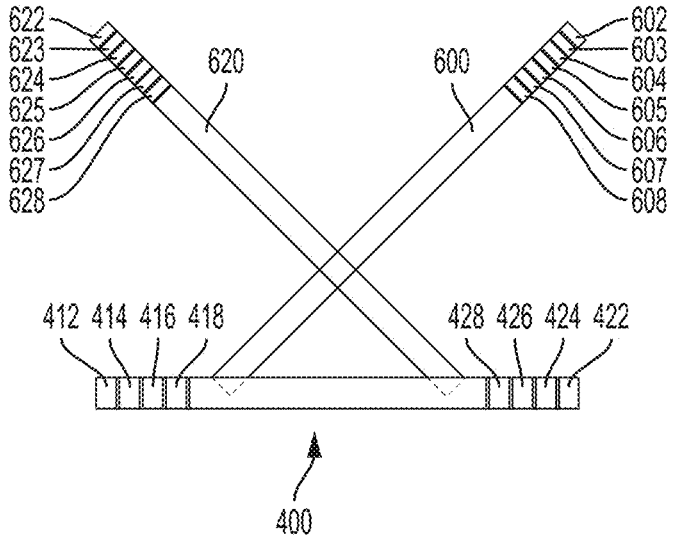
FIG. 10A is a view of the shoulder straps attached to the top bra strap, where the shoulder straps are in a first configuration.

FIG. 10A illustrates the "X" strap configuration of the top bra strap 400 and shoulder straps 600 and 602 in greater detail. In this embodiment, the top back strap 400 includes fastening loops 412, 414, 416 and 418 on the left side, and loops 422, 424, 426 and 428 on the right side as discussed in view of FIG. 4. The shoulder strap 620 include a number of fastening loops 622-628 disposed on a front end, and shoulder strap 600 include a number of fastening loops 602-608 disposed on a front end. Back ends of the shoulder straps 600 and 620 are coupled near opposing ends of the top back strap 400 so that the shoulder straps 600 and 620 cross each other, forming an "X" around the shoulder area of the wearer. It should be understood that while each of the shoulder straps are shown to include 7 fastening loops, any number of fastening loops (e.g. 1-10) may be disposed at the front end of the shoulder straps so that the wearer can easily adjust the length of the shoulder straps.

Figure 10B:
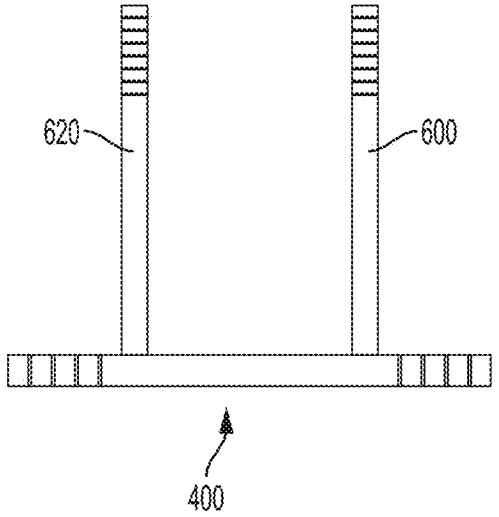
FIG. 10B is a view of the shoulder straps attached to the top bra strap, where the shoulder straps are in a second configuration.

FIG. 10B illustrates the "classic" strap configuration of the top bra strap 400 and shoulder straps 600 and 602. In this configuration, the front ends of shoulder straps 600 and 620 are attached to the bra main body 302 as discussed in view of FIG. 4. The straps 600 and 620 then extend over the mid-shoulder section and run down the wearer's back, where the back ends of the shoulder straps are attached toward respective ends of the top back strap 400 so that the shoulder straps 600 and 620 appear substantially parallel to each other at the wearer's back. The top bra strap 400 and shoulder straps 600 and 602 are illustrated with multiple fastening loops as shown in FIG. 10A, but it should be understood that any number of fastening loops may be disposed on the straps.

Figure 10C:
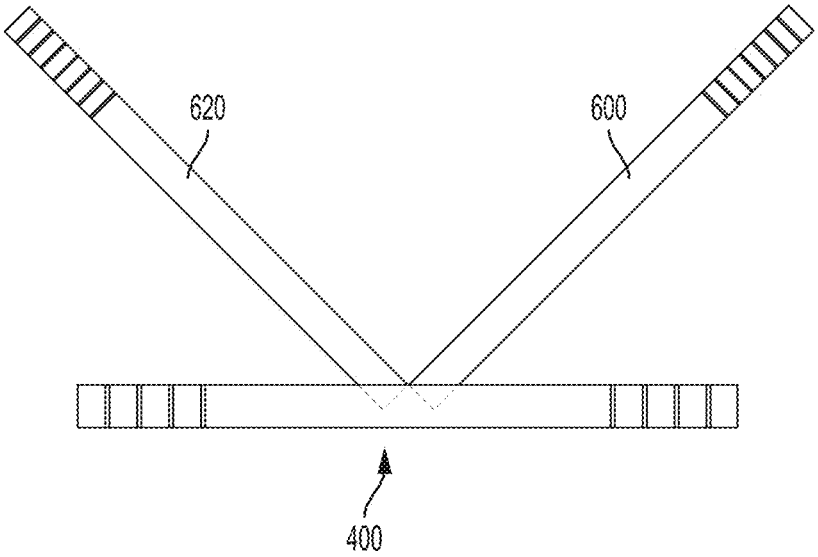
FIG. 10C is a view of the shoulder straps attached to the top bra strap, where the shoulder straps are in a third configuration.

FIG. 10C illustrates a "center-fuse" strap configuration of the top bra strap 400 and shoulder straps 600 and 602. In this configuration, the front ends of shoulder straps 600 and 620 are attached to the bra main body 302 as discussed in view of FIG. 4. The straps 600 and 620 then extend over the mid-shoulder section and run down the wearer's back, where the back ends of both shoulder straps are attached to substantially the center of the top back strap 400. The top bra strap 400 and shoulder straps 600 and 602 are illustrated with multiple fastening loops as shown in FIG. 10A, but it should be understood that any number of fastening loops may be disposed on the straps.

The bra 300 as disclosed above provides bust support for larger-busted women, and yet remains practically invisible under leotards, costumes, tank tops, low-cut tops, tennis outfits, gowns, cutaway tops, lacey tops, dresses, dance leotards, and other types of outer wear. The bra main body 302 may include cup members 350 that support a range of bust sizes, including cup sizes A through D and up. The straps 400, 500, 600 and 620 may be made from matte plastic, lycra and nylon, or any other flexible and easily molded material. In an embodiment, the straps 400, 500, 600 and 620 are clear, transparent, or otherwise barely visible to the eye when worn. The straps 400, 500, 600 and 620 may also be different colored or patterned so as to blend in with the wearer's clothing, skin tone, and/or aesthetic desire. Particularly, the shoulder straps 600 and 620 may be between 300 to 400 mm in length, between 20 to 30 mm in width, where the fastener loops disposed on the shoulder straps are 5 to 15 mm in width as measured along the length of the shoulder straps.

Although the bra 300 has been described to be particular useful for supporting active women with larger bust size, it will be appreciated that this disclosure is not limited to such use and not limited to the structure disclosed above. For example, the fasteners discussed need not be hook & loop type fasteners, but may also be hook & eyes, buckles, brackets, snap fasteners, or any other type of appropriate fasteners.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Further, a description of a technology in the "Background" is not to be construed as an admission that technology is prior art to any invention(s) in this disclosure. Neither is the "Brief Summary" to be considered as a characterization of the invention (s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. An article of clothing, comprising:

a main body having two cup members;

a top back strap having a first top back strap fastener on a first top back strap end and a second top back strap fastener on a second top back strap end;

a bottom back strap having a bottom back strap fastener on a first bottom back strap end; and first and second shoulder straps each having a front end and a back end, the front ends of the first and second shoulder straps each being attached to the main body and the back ends of the first and second shoulder straps each being attached to the top back strap, wherein the front end of the one or more shoulder straps include one or more shoulder strap loops.

2. The article of clothing of claim 1, wherein a width of the bottom back strap, as measured along a height of a wearer, is greater than a width of the top back strap.

3. The article of clothing of claim 1, wherein the first top back strap fastener, the second top back strap fastener, and the bottom back strap fastener each include two or more loops capable of receiving corresponding hooks of hook fasteners attached to the main body.

4. The article of clothing of claim 1, wherein a second bottom back strap end is sewn onto a boning strip of the main body.

5. The article of clothing of claim 1, wherein the top back strap, the bottom back strap, and the first and second shoulder straps are transparent.

6. The article of clothing of claim 1, wherein the cup members are configured to support wearers having cup sizes of C and greater.

7. The article of clothing of claim 1, further comprising a first top back strap hook operable to be coupled to the first top back strap fastener, and a second top back strap hook operable to be coupled to the second back strap fastener, wherein each of the back strap hooks are operable to be inserted into the corresponding back strap fasteners.

8. The article of clothing of claim 2, wherein the top back strap has a width of between 20 mm and 40 mm as measured along the height of the wearer.

9. A brassiere, comprising:

a main body attached to a first fastener, a second fastener, and a third fastener;

a first bra strap having a first end and a second end, the first end of the first bra strap including a plurality of first loops, and the second end of the first bra strap including a plurality of second loops; and a second bra strap having a first end and a second end, the first end of the second bra strap including a plurality of third loops, wherein a user is operable to select one of the plurality of first loops to be inserted into the first fastener, select one of the plurality of second loops to be inserted into the second fastener, and select one of the plurality of third loops into the third fastener.

10. The brassiere of claim 9, wherein the first fastener, second fastener, and third fastener are hook type fasteners.

11. The brassiere of claim 9, wherein the second end of the bra is directly coupled to the main body.

12. The brassiere of claim 11, wherein the second bra strap is wider than the first bra strap as measured along a height of a wearer.

13. The brassiere of claim 9, further comprising a first shoulder strap attached to the main body at a first end of the first shoulder strap, the first shoulder strap attached to the first bra strap at a second end of the first shoulder strap, a second shoulder strap attached to the main body at a first end of the second shoulder strap, and the second shoulder strap attached to the first bra strap at a second end of the second shoulder strap.

14. The brassiere of claim 13, wherein the first shoulder strap and the second shoulder strap intersect each other.

15. The brassiere of claim 13, wherein the second end of the first shoulder strap and the second shoulder strap are attached a first bra strap at a mid section of the first bra strap.

16. The brassiere of claim 13, wherein the first bra strap, the second bra strap, the first shoulder strap, and the second shoulder strap are transparent.

17. An article of clothing comprising, a main body having a first and second cup members, a first hook fastener disposed on a side of the first cup member, a second hook fastener disposed on a side of the second cup member, a third hook fastener disposed on a bottom side of the main body, a fourth hook fastener disposed on a top portion of the first cup member, and a fifth hook fastener disposed on a top portion the second cup member;

a first strap having a first end and a second end, the first end of the first strap including a plurality of first loops, and the second end of the first strap having a plurality of second loops;

a second strap having a first end and a second end, the first end of the second strap having a plurality of third loops, and the second end of the second strap is attached directly onto the main body;

a third strap having a first end and a second end, the first end of the third strap including a plurality of fourth loops, the second end of the third strap is attached directly onto the first strap; and a fourth strap having a first end and a second end, the first end of the fourth strap including a plurality of fifth loops, the second end of the fourth strap is attached directly onto the first strap, wherein a user is operable to select one of the first loops to be detachably inserted to accept the first hook fastener, select one of the second loops to be detachably inserted to accept the second hook fastener, select one of the third loops to be detachably inserted to accept the third hook fastener, select one of the fourth loops to be detachably inserted to accept the fourth hook fastener, and select one of the fifth loops to be detachably inserted to accept the fifth hook fastener.

18. The article of clothing of claim 17, wherein the first strap, second strap, third strap, and fourth strap are made from transparent materials.

19. The article of clothing of claim 17, wherein the main body is made from transparent material selected from the group consisting of polyester, nylon, elastane, and polyurethane.

* * * * *